US008598940B2

(12) United States Patent
Sun

(10) Patent No.: US 8,598,940 B2
(45) Date of Patent: Dec. 3, 2013

(54) LOW-VOLTAGE SOURCE BANDGAP REFERENCE VOLTAGE CIRCUIT AND INTEGRATED CIRCUIT

(75) Inventor: Hongquan Sun, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 308 days.

(21) Appl. No.: 13/161,217

(22) Filed: Jun. 15, 2011

(65) Prior Publication Data

US 2011/0309818 A1 Dec. 22, 2011

(30) Foreign Application Priority Data

Jun. 17, 2010 (CN) ..... 2010 1 0204753

(51) Int. Cl.
*G05F 3/20* (2006.01)

(52) U.S. Cl.
USPC ..... 327/513; 323/316

(58) Field of Classification Search
USPC ..... 323/214, 224, 226, 222, 234, 275, 277, 323/282–288, 312–316; 327/104, 107, 179, 327/294, 317, 305, 519, 418, 513, 540–541
See application file for complete search history.

(56) References Cited

U.S. PATENT DOCUMENTS 5,408,235 A * 4/1995 Doyle et al. ..... 341/143
5,864,504 A * 1/1999 Tanzawa et al. ..... 365/185.24
6,452,437 B1 * 9/2002 Takeuchi et al. ..... 327/513
6,489,835 B1 * 12/2002 Yu et al. ..... 327/539
6,724,235 B2 * 4/2004 Costa et al. ..... 327/378
2005/0035814 A1 2/2005 Ou-yang et al.
2009/0096526 A1 4/2009 Ishizuka

FOREIGN PATENT DOCUMENTS

CN 1581008 A 2/2005
CN 1949122 A 4/2007
CN 101042590 A 9/2007
CN 101644938 A 2/2010

OTHER PUBLICATIONS

Office Action (including partial English translation) issued in corresponding Chinese Patent Application 201010204753.6; mailed May 30, 2013.

* cited by examiner

*Primary Examiner* — Rajnikant Patel
(74) *Attorney, Agent, or Firm* — Brinks Gilson & Lione

(57) ABSTRACT

A low-voltage source bandgap reference voltage circuit is provided. In the circuit, a differential amplification module (301) is configured to provide negative feedback in a differential input manner, and has one input end connected to a bandgap core module (303), and the other input end connected to an output end of a mirror current module (302) and then connected to the bandgap core module (303); the mirror current module (302) is configured to provide a mirror current for the bandgap core module (303); the bandgap core module (303) is configured to provide a voltage for counteracting positive and negative temperature coefficients; and a starting module (304) is configured to start the low-voltage source bandgap reference voltage circuit, and has one input end connected to an output end of the differential amplification module (301), the other input end connected to a power supply (Vcc), and an output end connected to an output end of the bandgap core module (303) and then grounded. Therefore, the design of the starting circuit is simplified, the weak current conduction state is effectively prevented, and the startup risk is reduced.

12 Claims, 11 Drawing Sheets

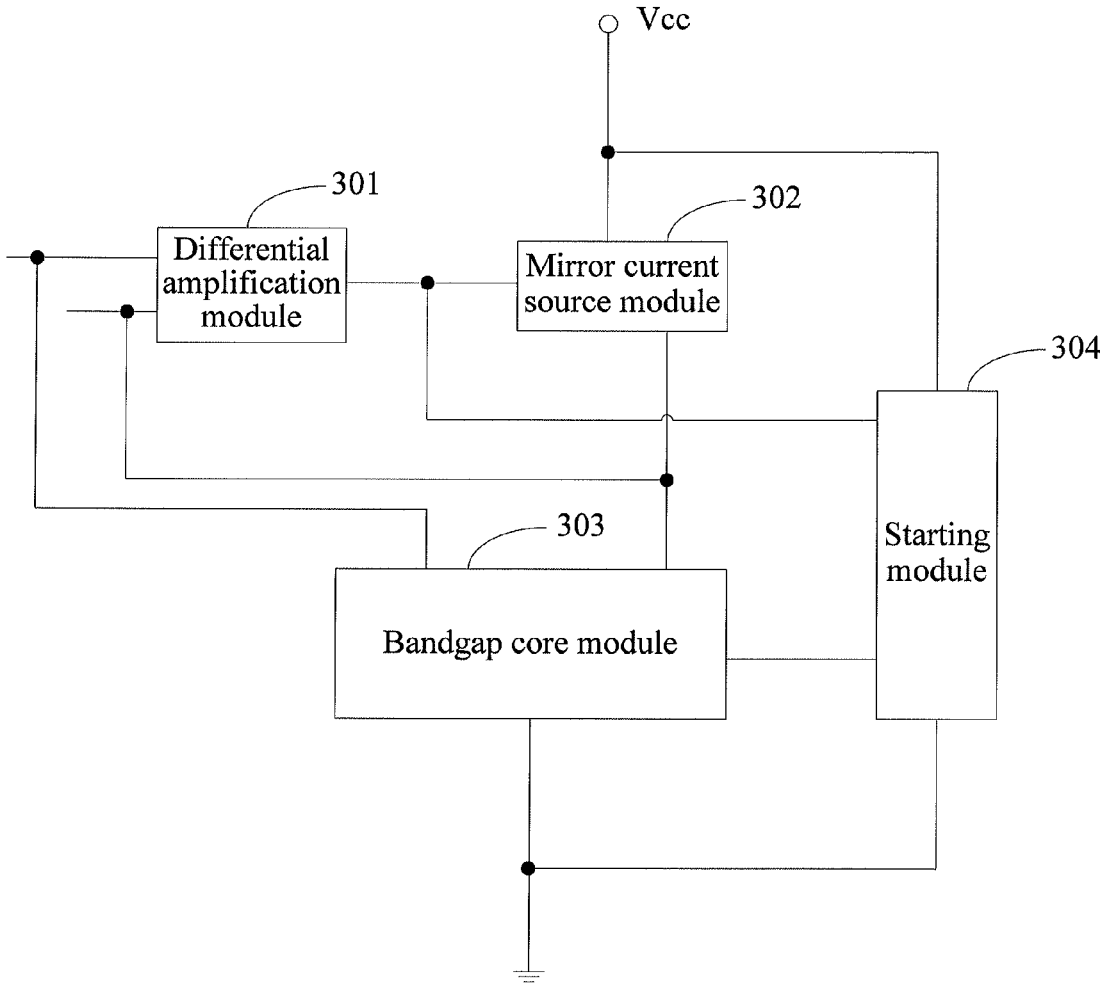
FIG. 3-a

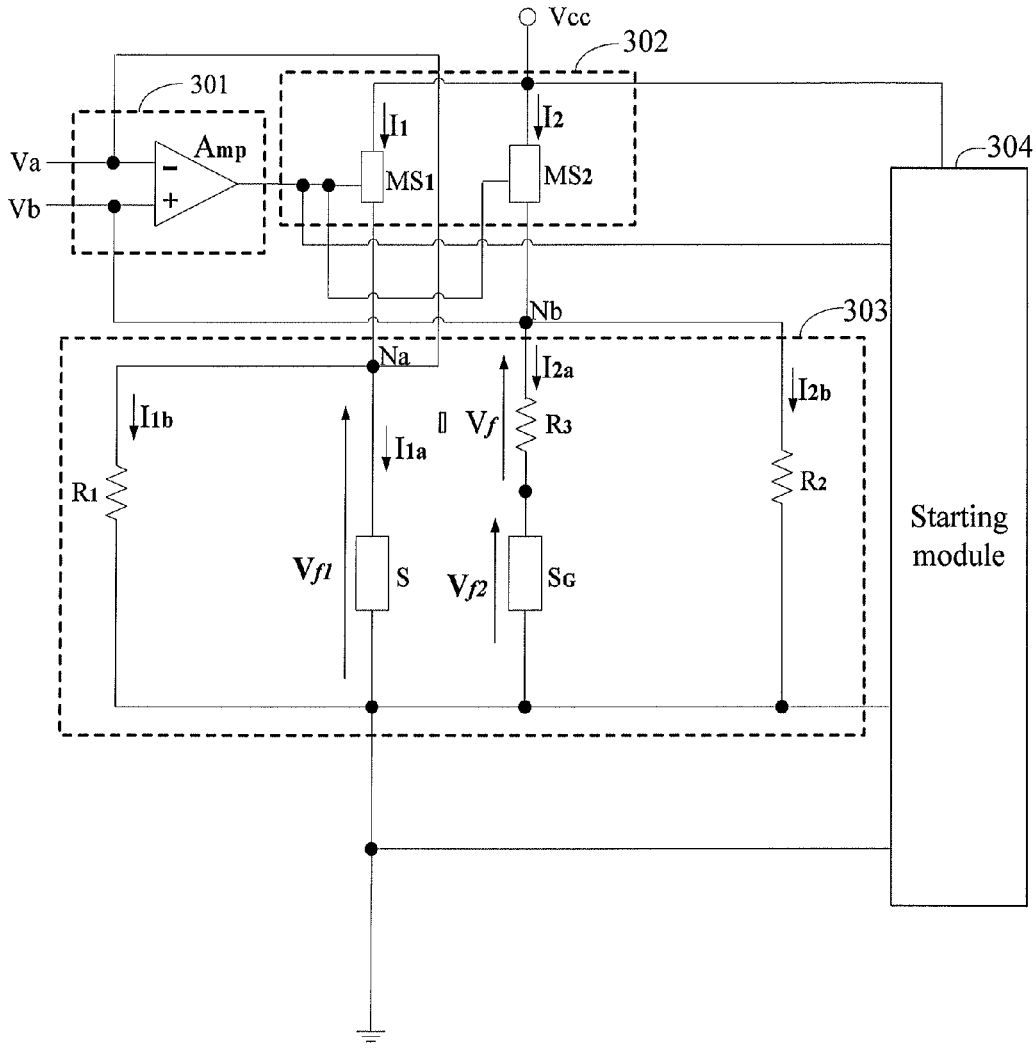
FIG. 3-b

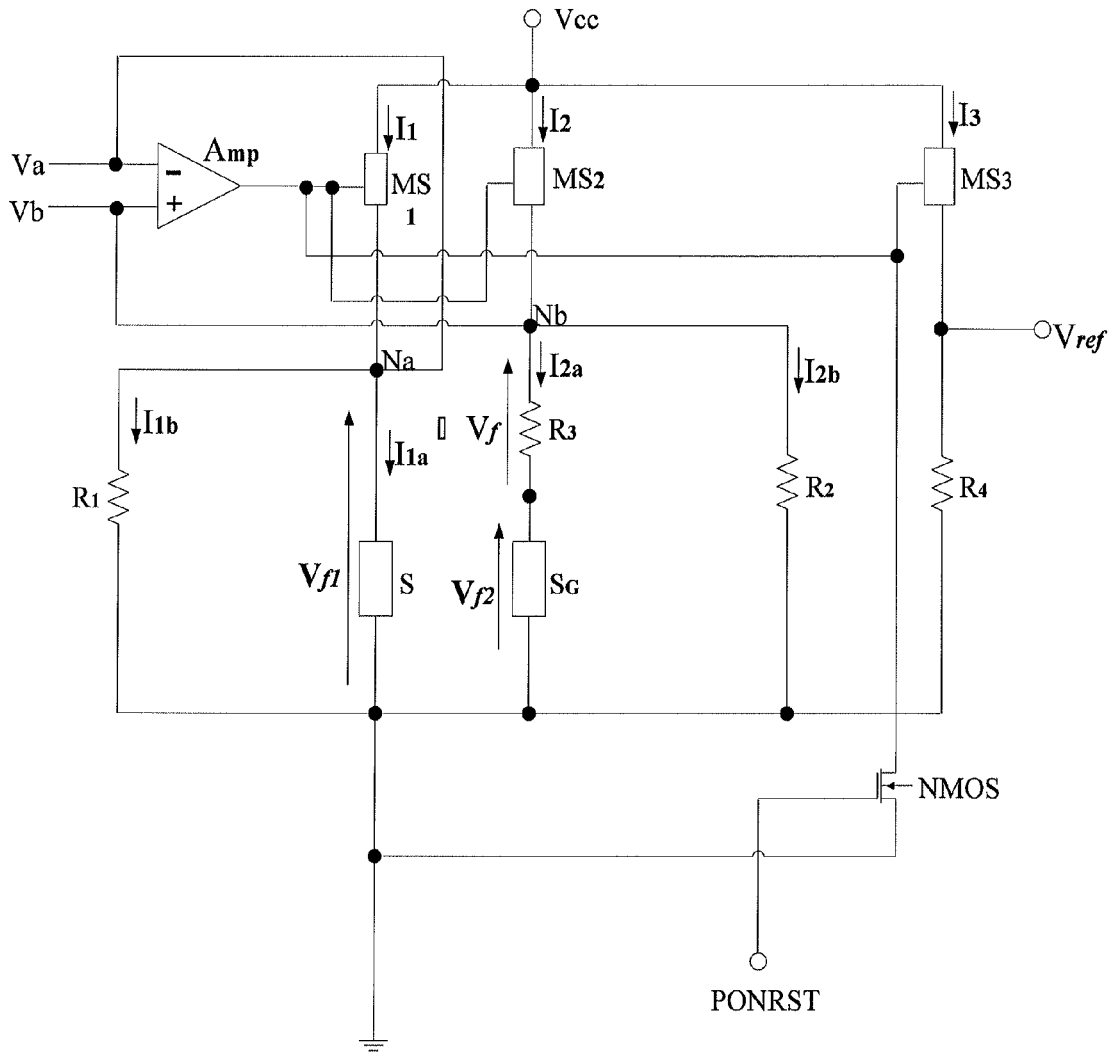
FIG. 3-c

LOW-VOLTAGE SOURCE BANDGAP REFERENCE VOLTAGE CIRCUIT AND INTEGRATED CIRCUIT

CROSS-REFERENCE TO RELATED APPLICATION

This application claims priority to Chinese Patent Application No. 201010204753.6, filed on Jun. 17, 2010, which is hereby incorporated by reference in its entirety.

FIELD OF THE INVENTION

The present invention relates to the field of integrated circuits, and in particular, to a low-voltage source bandgap reference voltage circuit and an integrated circuit.

BACKGROUND OF THE INVENTION

A reference voltage is an indispensable parameter in the design of an integrated circuit, and a bandgap reference voltage circuit is a solution for generating the reference voltage. The reference voltage (or current) generated by the bandgap reference voltage circuit should be independent of the process, voltage, and temperature (PVT) of the integrated circuit. For the limitation of the structure or size, the conventional bandgap reference voltage source circuit can only provide a reference voltage of about 1.25 V. When the voltage provided by a chip power supply is lower than 1.25 V, the operation of the conventional bandgap reference voltage source circuit becomes rather difficult.

A core part of a current-mode bandgap reference voltage source circuit provided in the prior art is as shown in FIG. 1. The principle that the current-mode bandgap reference voltage source circuit can provide a reference voltage is briefly analyzed in the following.

In the circuit shown in FIG. 1, three Positive Channel Metal Oxide Semiconductor (PMOS) transistors P1, P2 and P3 are of the same size, and resistances of a branch resistor R1 and a branch resistor R2 on two resistor branches are equal. A negative feedback network formed by an operational amplifier Amp enables a voltage Va at a node A to be equal to a voltage Vb at a node B (the nodes A and B are respectively connected to two input ends of the operational amplifier Amp, that is, Va and Vb are respectively equal to voltages of the input ends of the operational amplifier Amp). Because gates of P1, P2 and P3 are connected to an output end of the operational amplifier Amp, a relation of currents I1, I2, and I3 flowing towards drains of P1, P2 and P3 is I1=I2=I3. Furthermore, because Va=Vb, and R1=R2, I1*b*=I2*b*, and further, because I1=I2, I1*a*=I2*a*.

It is known from the circuit structure shown in the figure and the circuit law that:

$\Delta Vf=Vb-Vf2$, $Vb=Va$, and $Va=Vf1$, so $\Delta Vf=Vf1-Vf2=V_T\times \ln N$, where $V_T$ is a conduction voltage of each diode of N parallel-connected diodes in the figure;

$I2a=\Delta Vf/R3$;

$I2b=Vf1/R2$;

$I2=I2a+I2b$;

$I2=I3$, so $I3=I2a+I2b$;

the reference voltage output by the circuit is $Vref=R4\times I3=R4\times(I2a+I2b)=R4\times(\Delta Vf/R3+Vf1/R2)$.

Because Vf1 has a negative temperature coefficient, and ΔVf has a positive temperature coefficient, a reference voltage Vref independent of the PVT may be obtained by selecting appropriate R2 and R3, and reference voltages Vref having different values may be output by adjusting the resistance of the resistor R4.

A starting circuit is further required for normal operation of the current-mode bandgap reference voltage source circuit shown in FIG. 1. FIG. 2 shows a current-mode bandgap reference voltage source circuit having a starting circuit in the prior art. As shown in FIG. 2, before the circuit operates normally, a high level starting signal is first added on a gate of a Negative Channel Metal Oxide Semiconductor (NMOS) transistor shown by a dashed line block, the conduction of the NMOS transistor lowers a gate voltage V1 of the P3 transistor, and the circuit exits a zero current state, and enters an operation state.

Besides the zero current state and the operation state, the current-mode bandgap reference voltage source circuit shown in FIG. 1 may also have a middle state, that is, a weak current conduction state. The so-called weak current conduction state refers to that after the current-mode bandgap reference voltage source circuit exits the zero current state, if the voltage Va at the node A and the voltage Vb at the node B are too low to conduct the diode B1 and N parallel-connected diodes B connected in parallel with the resistor R1, the current only flows through the resistor branches, and no current flows through a branch where the diode B1 is located and a branch where the resistor R3 is located.

In the weak current conduction state, the operational amplifier Amp may still normally operate, and the voltage Va at the node A and the voltage Vb at the node B are still equal. However, because I2*a* is zero, according to the foregoing analysis of the current-mode bandgap reference voltage source circuit based on the circuit structure and the circuit law, in the weak current conduction state, the starting circuit provided by the prior art cannot enable the circuit to finally output a temperature independent voltage, so that the current-mode bandgap reference voltage source circuit may fail to start and cannot normally output a reference voltage.

SUMMARY OF THE INVENTION

Embodiments of the present invention provide a low-voltage source bandgap reference voltage circuit and an integrated circuit, so as to solve the problem in the prior art that the circuit fails to start and therefore cannot normally output a reference voltage in the weak current conduction state.

A low-voltage source bandgap reference voltage circuit includes a differential amplification module (301), a mirror current module (302), a bandgap core module (303) and a starting module (304). The differential amplification module (301) is configured to provide negative feedback in a differential input manner, and has one input end connected to the bandgap core module (303), and the other input end connected to an output end of the mirror current module (302) and then connected to the bandgap core module (303). The mirror current module (302) is configured to provide a mirror current for the bandgap core module (303). The bandgap core module (303) is configured to provide a voltage for counteracting positive and negative temperature coefficients. The starting module (304) is configured to start the low-voltage source bandgap reference voltage circuit, and has one input end connected to an output end of the differential amplification module (301), the other input end connected to a power supply (Vcc), and an output end connected to an output end of the bandgap core module (303) and then grounded.

An integrated circuit includes the foregoing low-voltage source bandgap reference voltage circuit.

Because the low-voltage source bandgap reference voltage circuit according to the embodiment of the present invention can automatically exit the weak current conduction state and enter an operation state, and the startup of the circuit can be achieved simply by using a conventional starting circuit, the design of the starting circuit is greatly simplified, the weak current conduction state is effectively prevented, and the startup risk is reduced.

BRIEF DESCRIPTION OF THE DRAWINGS

To illustrate the technical solutions according to the embodiments of the present invention more clearly, the accompanying drawings for describing the embodiments are introduced briefly in the following. Apparently, the accompanying drawings in the following description are only some embodiments of the present invention, and persons of ordinary skill in the art can derive other drawings from the accompanying drawings without creative efforts.

FIG. 3-*a* shows a low-voltage source bandgap reference voltage circuit having a starting circuit according to Embodiment 1 of the present invention;

FIG. 3-*b* shows a low-voltage source bandgap reference voltage circuit having a starting circuit according to Embodiment 2 of the present invention;

FIG. 3-*c* shows a low-voltage source bandgap reference voltage circuit having a starting circuit according to Embodiment 3 of the present invention;

DETAILED DESCRIPTION OF THE EMBODIMENTS

Figure 1:
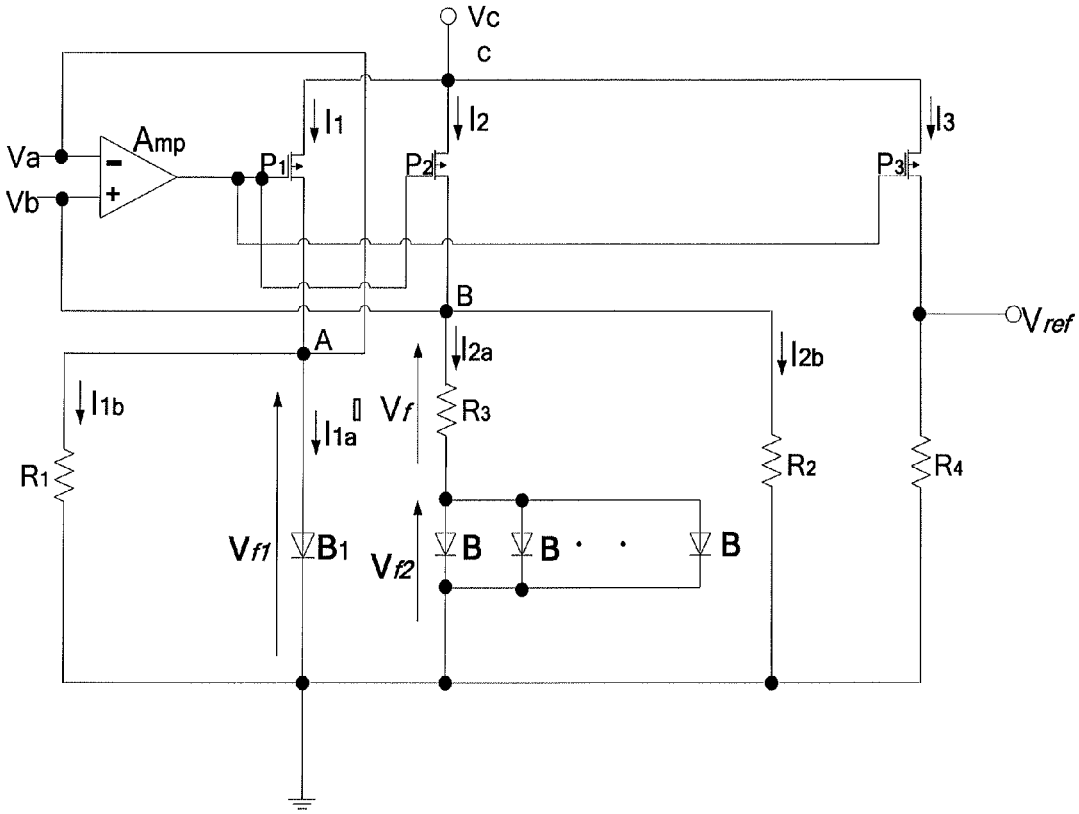
FIG. 1 shows a current-mode bandgap reference voltage source circuit in the prior art.
Figure 2:
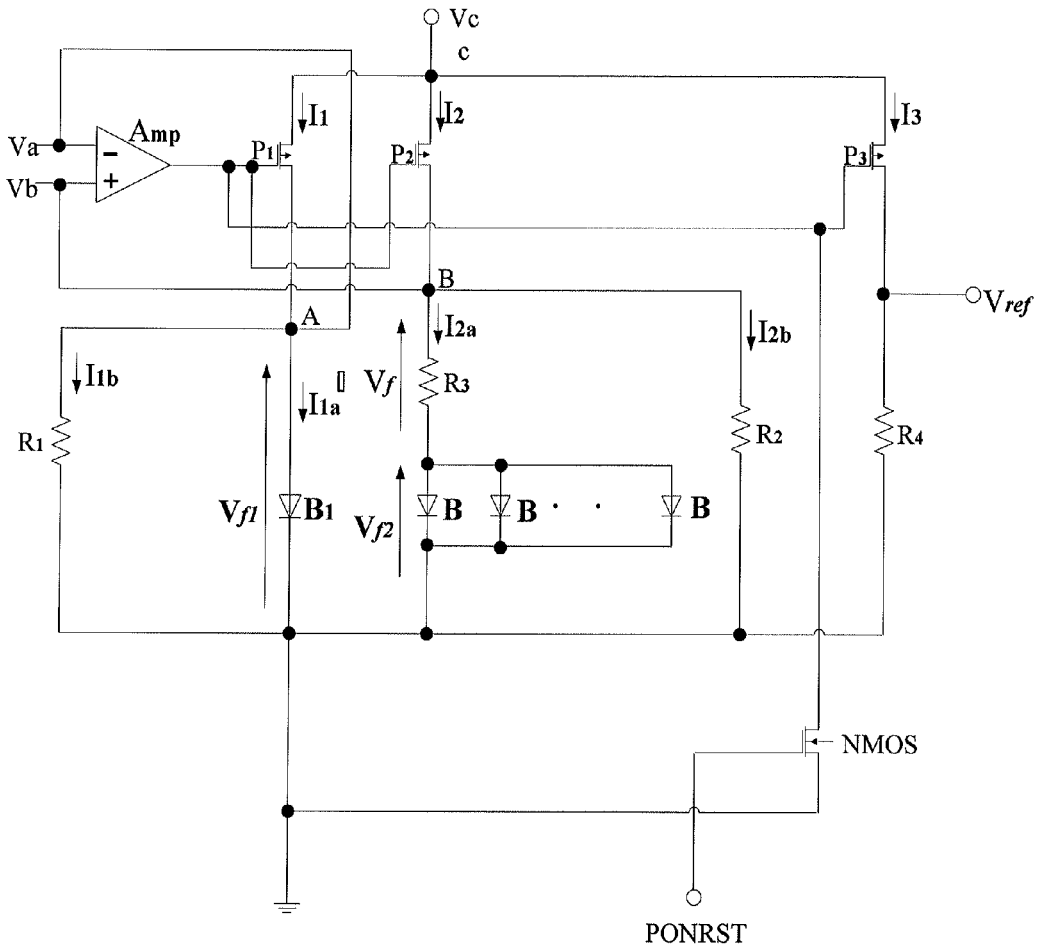
FIG. 2 shows a current-mode bandgap reference voltage source circuit having a starting circuit in the prior art.

The technical solutions of the present invention will be clearly described in the following with reference to the accompanying drawings. It is obvious that the embodiments to be described are only a part rather than all of the embodiments of the present invention. All other embodiments obtained by persons skilled in the art based on the embodiments of the present invention without creative efforts shall fall within the protection scope of the present invention.

FIG. 3-*a* is a diagram showing a low-voltage source bandgap reference voltage circuit according to Embodiment 1 of the present invention. Referring to FIG. 3-*a*, the circuit includes a differential amplification module 301, a mirror current module 302, a bandgap core module 303 and a starting module 304.

The differential amplification module 301 is configured to provide negative feedback in a differential input manner, and has one input end connected to the bandgap core module 303, and the other input end connected to an output end of the mirror current module 302 and then connected to the bandgap core module 303. The mirror current module 302 is configured to provide a mirror current for the bandgap core module 303. The bandgap core module 303 is configured to provide a voltage for counteracting positive and negative temperature coefficients. The starting module 304 is configured to start the entire low-voltage source bandgap reference voltage circuit, and has one input end connected to an output end of the differential amplification module 301, the other input end connected to a power supply (Vcc), and an output end connected to an output end of the bandgap core module 303 and then grounded.

FIG. 3-*b* is a diagram showing a low-voltage source bandgap reference voltage circuit according to Embodiment 2 of the present invention. Referring to FIG. 3-*b*, in the circuit according to this embodiment, a bandgap core module (303) includes a first resistor (R1), a second resistor (R2), a third resistor (R3), a switching element (S), and a switching element group (SG). A differential amplification module (301) is an operational amplifier (Amp). A mirror current module (302) includes a first mirror current source module (MS1) and a second mirror current source module (MS2). The first resistor (R1) is connected in parallel with the switching element (S), and the switching element group (SG) is connected in series with the third resistor (R3).

One end of the second resistor (R2), one end of the third resistor (R3) and one output end of the second mirror current source module (MS2) are connected to a non-inverting input end of the operational amplifier (Amp), and one end of the first resistor (R1), one end of the switching element (S) and one output end of the first mirror current source module (MS1) are connected to an inverting input end of the operational amplifier (Amp).

In this embodiment, the resistance of the first resistor (R1) is greater than that of the second resistor (R2).

FIG. 3-*c* is a diagram showing a low-voltage source bandgap reference voltage circuit according to Embodiment 3 of the present invention. Referring to FIG. 3-*c*, the low-voltage source bandgap reference voltage circuit includes an operational amplifier (Amp), a first mirror current source module (MS1), a second mirror current source module (MS2), a third mirror current source module (MS3), a first resistor (R1), a second resistor (R2), a third resistor (R3), a fourth resistor (R4), a switching element (S), a switching element group (SG) and an NMOS transistor.

In this embodiment, the first mirror current source module (MS1), the second mirror current source module (MS2) and the third mirror current source module (MS3) respectively have two input ends (including a first input end and a second input end) and an output end. The first input ends of the mirror current source modules are connected to a power supply (Vcc), and the second input end of the first mirror current source module (MS1), the second input end of the second mirror current source module (MS2), the second input end of the third mirror current source module (MS3) and a drain of the NMOS transistor are connected to an output end of the operational amplifier (Amp).

The power supply (Vcc) provides input currents I1, I2, and I3 for the corresponding mirror current source modules from the first input ends of the mirror current source modules connected to the power supply (Vcc). Among the mirror current source modules, currents I'2 and I'3 output by two mirror current source modules are m times and n times of a current P1 output by another mirror current source module, for example, the relation of the current I'2 output by the second mirror current source module (MS2), the current P3 output by the third mirror current source module (MS3) and the current I'1 output by the first mirror current source module (MS1) may be I'2=mI'1, and I'3=nI'1; and in particular, in this embodiment, the relation of the current I'2 output by the second mirror current source module (MS2), the current I'3 output by the third mirror current source module (MS3) and the current I'1 output by the first mirror current source module (MS1) may be I'1=I'2=I'3.

The first resistor (R1) is connected in parallel with the switching element (S); one end of the first resistor (R1), one end of the switching element (S) and one output end of the first mirror current source module (MS1) are connected to an inverting input end of the operational amplifier (Amp); and the one end of the first resistor (R1), the one end of the switching element (S) and the one output end of the first mirror current source module (MS1) form a node (Na). The switching element group (SG) is connected in series with the third resistor (R3); one end of the third resistor (R3), one end of the second resistor (R2) and one output end of the second mirror current source module (MS2) are connected to a non-inverting input end of the operational amplifier (Amp); and the one end of the third resistor (R3), the one end of the second resistor (R2) and the one output end of the second mirror current source module (MS2) form a node (Nb).

The other end of the first resistor (R1), the other end of the switching element (S), the other end of the second resistor (R2), one end of the fourth resistor (R4), one end of the switching element group (SG) and a source of the NMOS transistor are connected to the ground, and the other end of the fourth resistor (R4) is connected to one output end of the third mirror current source module (MS3).

In this embodiment, the resistance of the first resistor (R1) is greater than that of the second resistor (R2).

Figure 4:
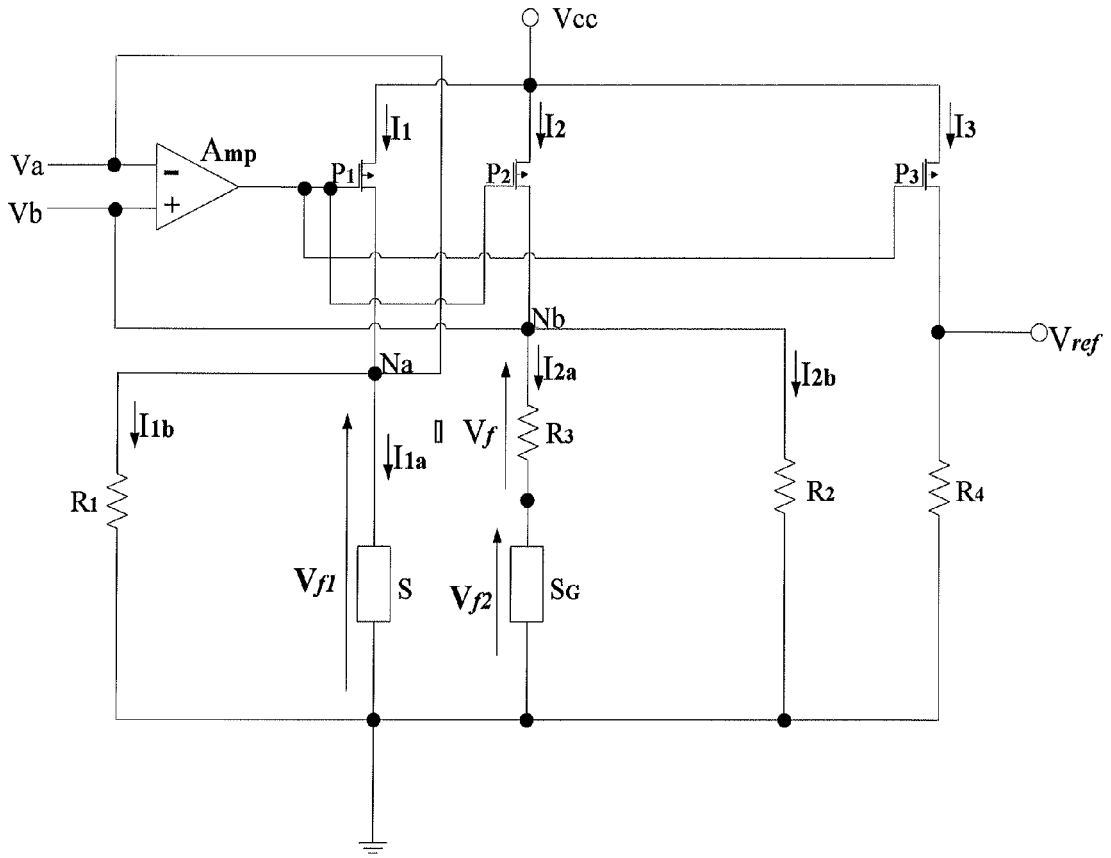
FIG. 4 shows a low-voltage source bandgap reference voltage circuit according to Embodiment 4 of the present invention.

In the embodiment of the present invention, the first mirror current source module (MS1), the second mirror current source module (MS2), and the third mirror current source module (MS3) may respectively be a first PMOS transistor (P1), a second PMOS transistor (P2) and a third PMOS transistor (P3). FIG. 4 shows a low-voltage source bandgap reference voltage circuit according to Embodiment 3 of the present invention. As shown in FIG. 4, a source, a gate and a drain of each PMOS transistor respectively form the first input end, the second input end and the output end of each mirror current source module.

Figure 5:
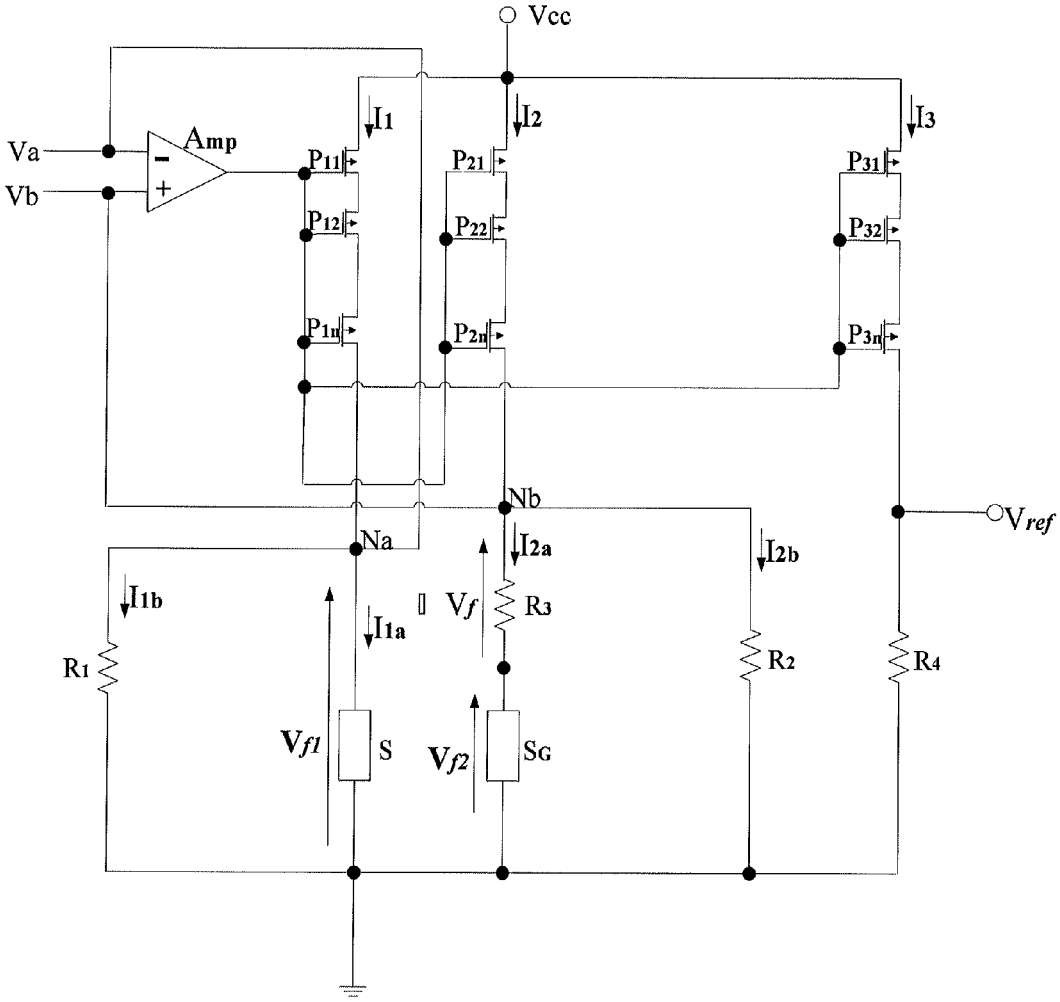
FIG. 5 shows a low-voltage source bandgap reference voltage circuit according to Embodiment 5 of the present invention.

As another embodiment of the present invention, a first mirror current source module (MS1), a second mirror current source module (MS2) and a third mirror current source module (MS3) may be n series-connected PMOS transistors. FIG. 5 shows a low-voltage source bandgap reference voltage circuit according to Embodiment 4 of the present invention. In each mirror current source module formed by the n series-connected PMOS transistors, a connection relation of the PMOS transistors is that: gates of the PMOS transistors are connected together, and for any two adjacent PMOS transistors, a source of one PMOS transistor is connected to a drain of the other PMOS transistor, in which in each mirror current source module, a source of a first PMOS transistor, a gate of any PMOS transistor and a drain of a last PMOS transistor form a first input end, a second input end and an output end of each mirror current source module. In this embodiment, n is a natural number greater than 1, for example, n may be 2.

The low-voltage source bandgap reference voltage circuit according to Embodiment 3 of the present invention shown in FIG. 4 is taken as an example in the following to describe in detail the operating principle of the low-voltage source bandgap reference voltage circuit according to the embodiment of the present invention.

In the low-voltage source bandgap reference voltage circuit shown in FIG. 4, the first PMOS transistor (P1), the second PMOS transistor (P2) and the third PMOS transistor (P3) may be of the same size, the resistance of the first resistor (R1) is greater than that of the second resistor (R2), the sources of the PMOS transistors are connected to the power supply Vcc, the gates of the PMOS transistors are connected to the output end of the operational amplifier (Amp), and the voltage across the two ends of the fourth resistor (R4) is a reference voltage output by the circuit.

The first resistor (R1) is connected in parallel with the switching element (S), a node (Na) formed by the first resistor (R1) and the switching element (S) is connected to the drain of the first PMOS transistor (P1), and the other node formed by the first resistor (R1) and the switching element (S) is connected to the ground (that is, grounded). The switching element group (SG) is formed by N parallel-connected switching elements, a branch formed by a series connection of the switching element group (SG) and the third resistor (R3) is connected in parallel with the second resistor (R2), and a node (Nb) formed by the third resistor (R3) and the second resistor (R2) is connected to the drain of the second PMOS transistor (P2).

In the circuit shown in FIG. 4, because the first PMOS transistor (P1) and the second PMOS transistor (P2) are of the same size, and the sources of the first PMOS transistor (P1) and the second PMOS transistor (P2) are both connected to the power supply Vcc, a source current I1 of the first PMOS transistor (P1) is equal to a source current I2 of the second PMOS transistor (P2). It is assumed that the current is in a weak current conduction state, that is, a voltage Va at the node (Na) and a voltage Vb at the node (Nb) are too low to conduct the switching element group (SG) and the switching element (S), and the currents I1 and I2 only flow through a branch where the resistor R1 is located and a branch where the second resistor (R2) is located respectively.

In this embodiment, the resistance of the first resistor (R1) is greater than that of the second resistor (R2), and according to the foregoing analysis, the current of the branch where the first resistor (R1) is located is equal to that of the branch where the second resistor (R2) is located, that is, I1=I2, so it is known from Va=R1×I1 and Vb=R2×I2 that the voltage Va at the node (Na) is finally greater than the voltage Vb at the node (Nb).

According to the property of the operational amplifier, when the voltage of the inverting input end of the operational amplifier is greater than the voltage of the non-inverting input end of the operational amplifier, the voltage of the output end is 0. Therefore, in the embodiment of the present invention, when the voltage Va at the node (Na) is greater than the voltage Vb at the node (Nb), the voltage of the output end of the operational amplifier (Amp) is 0, that is, gate voltages of the first PMOS transistor (P1) and the second PMOS transistor (P2) are both 0.

When the gate voltages of the first PMOS transistor (P1) and the second PMOS transistor (P2) are both 0, a strong current passes through the first PMOS transistor (P1) and the second PMOS transistor (P2). Because Va=R1×I1, and Vb=R2×I2, the voltage Va at the node (Na) and the voltage Vb at the node (Nb) are further increased, so that, Va is greater than VTS, and Vb is greater than VTSG. Here, VTS is a conduction voltage of the switching element (S) (indicating that the switching element (S) is conducted when the voltage applied on the switching element (S) is greater than VTS), and VTSG is a conduction voltage of the switching element group (SG) (indicating that the switching element group (SG) is conducted when the voltage applied on the switching element group (SG) is greater than VTSG). Once Va is greater than VTS, and Vb is greater than VTSG, both the switching element (S) and the switching element group (SG) are conducted, there is a current flowing through the branch where the switching element (S) is located and the branch where the switching element group (SG) is located, and the circuit exits the weak current conduction state and enters an operation state (there is a current flowing through the branches where the first resistor (R1), the switching element (S), the second resistor (R2) and the switching element group (SG) are located).

Figure 6:
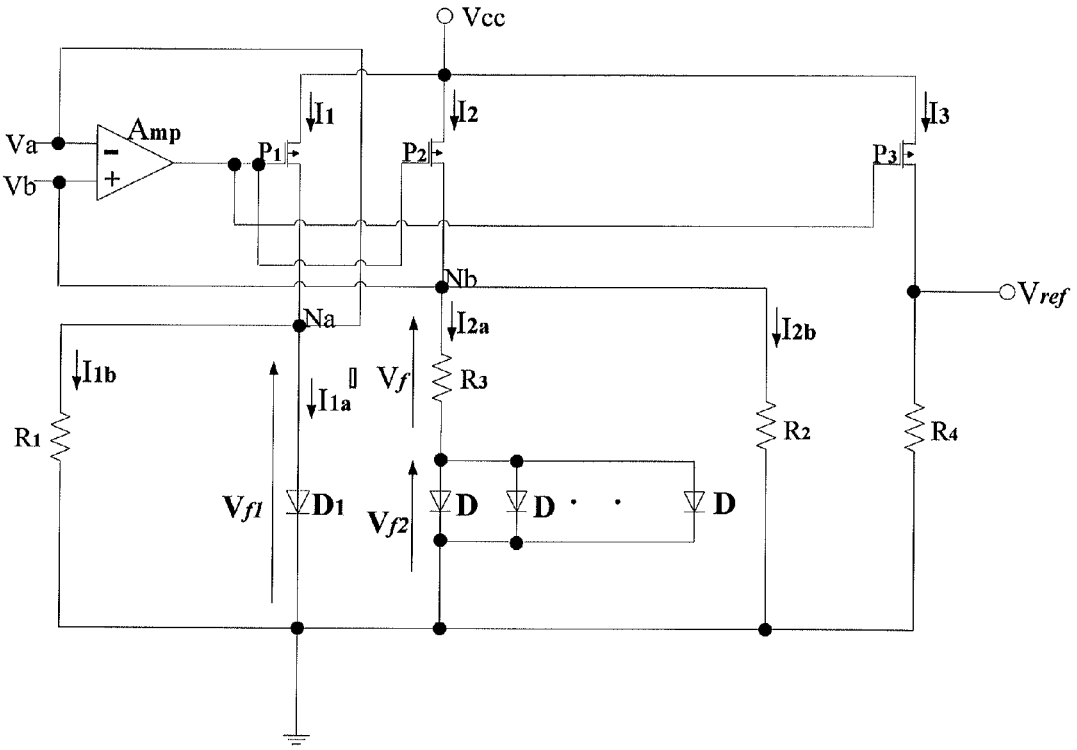
FIG. 6 shows a low-voltage source bandgap reference voltage circuit according to Embodiment 6 of the present invention.

In the embodiment of the present invention, the switching element (S) may be a diode (D1), the switching element group (SG) may be N parallel-connected diodes (D), and N is a natural number greater than 1, for example, N may be 8, as shown in FIG. 6.

Figure 7:
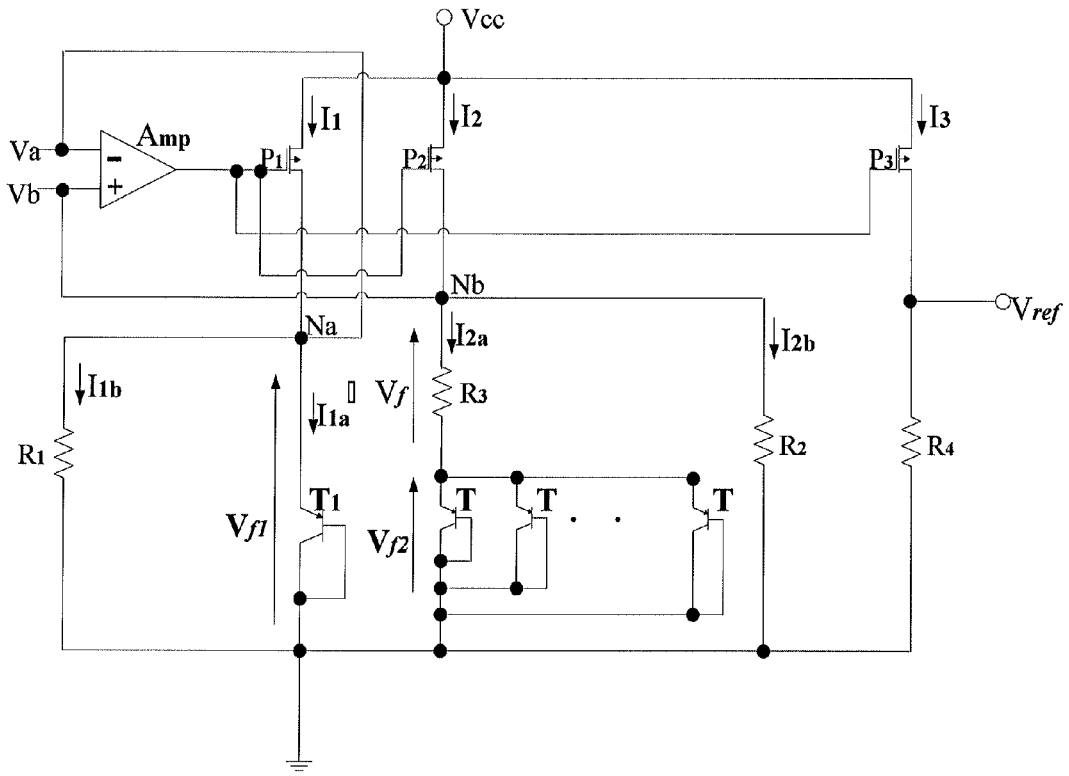
FIG. 7 shows a low-voltage source bandgap reference voltage circuit according to Embodiment 7 of the present invention.

In order to control the process more accurately, in another embodiment of the present invention, a switching element (S) may be a triode (T1), and a switching element group (SG) may be N (N is a natural number greater than 1, for example, N may be 8) parallel-connected triodes (T), as shown in FIG. 7. In the embodiment shown in FIG. 7, a base and a collector of the triode (T1) are short circuited and connected to the ground, and a base and a collector of each triode among the N parallel-connected triodes (T) are respectively short circuited and connected to the ground.

FIG. 6 is taken as an example to describe the principle that the low-voltage source bandgap reference voltage circuit according to the embodiment of the present invention generates the reference voltage. As described above, after the circuit exits the weak current conduction state and enters the operation state, a negative feedback network formed by the operational amplifier (Amp) enables the voltage Va at the node (Na) to be equal to the voltage Vb at the node (Nb). Because the gates of the first PMOS transistor (P1), the second PMOS transistor (P2) and the third PMOS transistor (P3) are connected to the output end of the operational amplifier (Amp), the relation of the currents I2 and I3 flowing towards the sources of the second PMOS transistor (P2) and the third PMOS transistor (P3) is I2=I3.

For the convenience of description, in this embodiment, it is assumed that all the diodes in the circuit shown in FIG. 6 have the same parameters (for example, have the same conduction voltage); however, it should be understood by persons skilled in the art that the corresponding parameters of the diodes in the circuit shown in FIG. 6 may be different, that is, the assumption of this embodiment shall not be construed as a limit to the present invention. It is known from the circuit structure shown in FIG. 6 and the circuit law that:

$\Delta Vf=Vb-Vf2$, $Vb=Va$, $Va=Vf1=V_T\times\ln(I1a/Is)$, and $Vf2=V_T\times\ln(I2a/(N\times Is))$, so $\Delta Vf=Vf1-Vf2=V_T\times\ln(I1a/Is)$, where $V_T$ is a conduction voltage of each diode in the figure, and Is is a saturation current of each diode in the figure;

$I2a=\Delta Vf/R3$;

$I2b=Vf1/R2$;

$I2=I2a+I2b$ and $I2=I3$, so $I3=I2a+I2b$; and the reference voltage output by the circuit is $Vref=R4\times I3=R4\times(I2a+I2b)=R4\times(\Delta Vf/R3+Vf1/R2)$.

Because Vf1 has a negative temperature coefficient, and ΔVf has a positive temperature coefficient, a reference voltage Vref independent of the PVT may be obtained by selecting appropriate R2 and R3, and reference voltages Vref having different values may be output by adjusting the resistance of the resistor R4.

The operating principle of the current-mode bandgap reference voltage source circuit according to the embodiment of the present invention shown in FIG. 5 is the same as the operating principle of the current-mode bandgap reference voltage source circuit according to the embodiment of the present invention shown in FIG. 4, and will not be described herein again.

Figure 8:
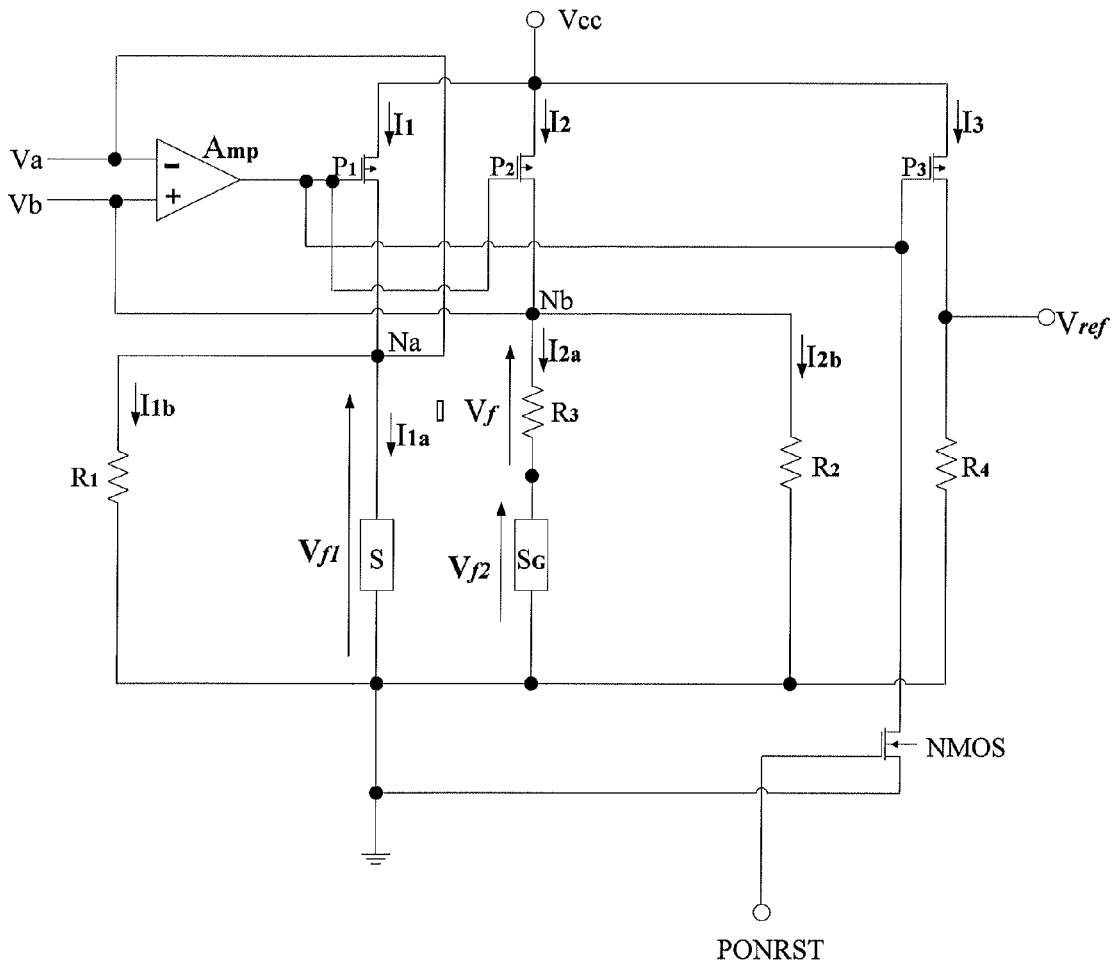
FIG. 8 shows a low-voltage source bandgap reference voltage circuit having a starting circuit according to Embodiment 8 of the present invention.

As shown in FIG. 8, a starting circuit is further required for normal operation of the current-mode bandgap reference voltage source circuit shown in FIG. 4, 5, 6 or 7.

It may be known from the foregoing analysis that, the low-voltage source bandgap reference voltage circuit shown in FIG. 4, 5, 6 or 7 can automatically exit the weak current conduction state and enter an operation state, and the startup of the circuit can be achieved simply by using a conventional starting circuit, thereby greatly simplifying the design of the starting circuit, effectively preventing the weak current conduction state, and reducing the startup risk.

Figure 9:
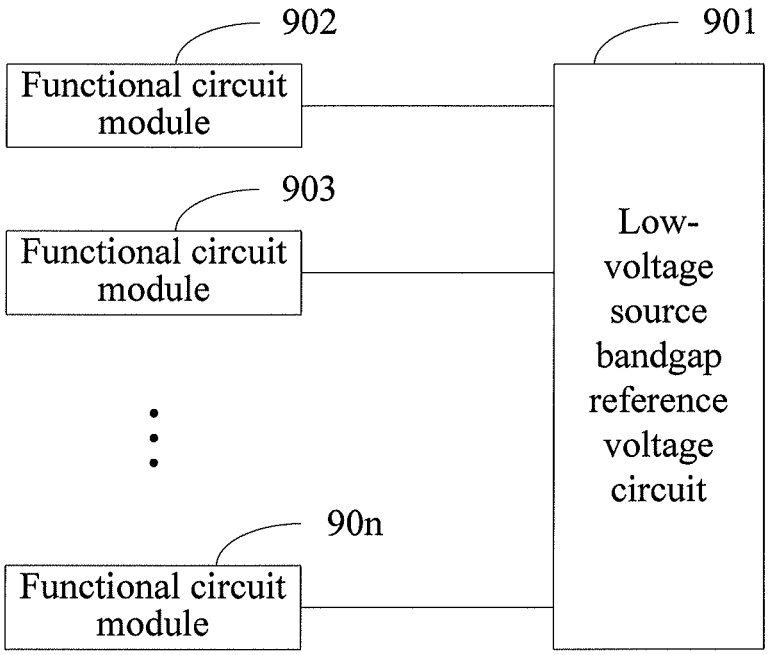
FIG. 9 shows an integrated circuit according to Embodiment 9 of the present invention.

An embodiment of the present invention further provides an integrated circuit, as shown in FIG. 9. The integrated circuit includes a low-voltage source bandgap reference voltage circuit 901 according to the foregoing embodiments of the present invention, and other functional circuit modules 902 (for example, a digital-to-analog conversion circuit), 903, . . . , and 90*n*. After being started, the low-voltage source bandgap reference voltage circuit 901 can provide a stable reference voltage for the other functional circuit modules (for example, the functional circuit module 902) in the integrated circuit.

The low-voltage source bandgap reference voltage circuit and the integrated circuit according to the embodiments of the present invention are introduced in detail above. The principle and implementation of the present invention are described herein through specific examples. The description about the embodiments of the present invention is merely provided for ease of understanding of the method and core ideas of the present invention. Persons of ordinary skill in the art can make variations and modifications to the present invention in terms of the specific implementations and application scopes according to the ideas of the present invention. Therefore, the specification shall not be construed as a limit to the present invention.

What is claimed is:

1. A low-voltage source bandgap reference voltage circuit, comprising: a differential amplification module, a mirror current module, a bandgap core module and a starting module, wherein the differential amplification module is configured to provide negative feedback in a differential input manner, the differential amplification module has one input end connected to the bandgap core module, and the other input end connected to an output end of the mirror current module and then connected to the bandgap core module;

the mirror current module is configured to provide a mirror current for the bandgap core module;

the bandgap core module is configured to provide a voltage for counteracting positive and negative temperature coefficients; and the starting module is configured to start the low-voltage source bandgap reference voltage circuit, the starting module has one input end connected to an output end of the differential amplification module, the other input end connected to a power supply (Vcc), and an output end connected to an output end of the bandgap core module and then grounded, wherein the bandgap core module comprises a first resistor (R1), a second resistor (R2), a third resistor (R3), a switching element (S) and a switching element group (SG), the differential amplification module is an operational amplifier (Amp), and the mirror current module comprises a first mirror current source module (MS1) and a second mirror current source module (MS2);

the first resistor (R1) is connected in parallel with the switching element (S), and the switching element group (SG) is connected in series with the third resistor (R3);

one end of the second resistor (R2), one end of the third resistor (R3) and one output end of the second mirror current source module (MS2) are connected at a second node (Nb) and to a non-inverting input end of the operational amplifier (Amp), and one end of the first resistor (R1), one end of the switching element (S) and one output end of the first mirror current source module (MS1) are connected at a first node (Na) and to an inverting input end of the operational amplifier (Amp); and a resistance of the first resistor (R1) is greater than that of the second resistor (R2), wherein, in a weak current conduction state, the voltage of the inverting input end of the operational amplifier (Amp) is greater than the voltage of the non-inverting input end of the operational amplifier (Amp) for the resistance of the first resistor (R1) is greater than that of the second resistor (R2), the currents through the first mirror current source module (MS1) and the second mirror current source module (MS2) are increased, and the voltage Va at the first node (Na) and the voltage Vb at the second node (Nb) are respectively further increased when the voltage of the inverting input end of the operational amplifier (Amp) is greater than the voltage of the non-inverting input end of the operational amplifier (Amp), and the switching element (S) and the switching element group (SG) are accordingly conducted.

2. The low-voltage source bandgap reference voltage circuit according to claim 1, wherein the starting module comprises a third mirror current source module, a fourth resistor and a Negative Channel Metal Oxide Semiconductor (NMOS) transistor;

a first input end of the first mirror current source module, a first input end of the second mirror current source module and a first input end of the third mirror current source module are connected to the power supply, and a second input end of the first mirror current source module, a second input end of the second mirror current source module, a second input end of the third mirror current source module and a drain of the NMOS transistor are connected to an output end of the operational amplifier;

the other end of the first resistor, the other end of the switching element, the other end of the second resistor, one end of the fourth resistor, one end of the switching element group and a source of the NMOS transistor are connected to a ground; and the other end of the fourth resistor is connected to one output end of the third mirror current source module.

3. The low-voltage source bandgap reference voltage circuit according to claim 2, wherein the first mirror current source module, the second mirror current source module and the third mirror current source module are respectively a first Positive Channel Metal Oxide Semiconductor (PMOS) transistor, a second PMOS transistor and a third PMOS transistor, and the first input end, the second input end and the output end of the each mirror current source module are respectively a source, a gate and a drain of the each PMOS transistor.

4. The low-voltage source bandgap reference voltage circuit according to claim 2, wherein the first mirror current source module, the second mirror current source module and the third mirror current source module are n series-connected PMOS transistors, and a connection relation of the n series-connected PMOS transistors is that: gates of the PMOS transistors are connected together, and for any two adjacent PMOS transistors, a source of one PMOS transistor is connected to a drain of the other PMOS transistor, and the n is a natural number greater than 1; and the first input end, the second input end and the output end of the each mirror current source module are respectively a source of a first PMOS transistor, a gate of any PMOS transistor and a drain of a last PMOS transistor among the corresponding n series-connected PMOS transistors.

5. The low-voltage source bandgap reference voltage circuit according to claim 2, wherein the switching element is a diode, and the switching element group comprises a plurality of parallel-connected diodes.

6. The low-voltage source bandgap reference voltage circuit according to claim 2, the switching element is a triode, and the switching element group comprises a plurality of parallel-connected triodes, a base and a collector of the triode are short circuited and connected to the ground, and a base and a collector of each triode among the parallel-connected triodes are respectively short circuited and connected to the ground.

7. An integrated circuit, comprising a low-voltage source bandgap reference voltage circuit, and a digital-to-analog conversion circuit, the low-voltage source bandgap reference voltage circuit provides a reference voltage for the digital-to-analog conversion circuit, wherein the low-voltage source bandgap reference voltage circuit comprises a differential amplification module, a mirror current module, a bandgap core module and a starting module, wherein the differential amplification module is configured to provide negative feedback in a differential input manner, the differential amplification module has one input end connected to the bandgap core module and the other input end connected to an output end of the mirror current module and then connected to the bandgap core module, wherein the mirror current module is configured to provide a mirror current for the bandgap core module, wherein the bandgap core module is configured to provide a voltage for counteracting positive and negative temperature coefficients, and wherein the starting module is configured to start the low-voltage source bandgap reference voltage circuit, the starting module has one input end connected to an output end of the differential amplification module the other input end connected to a power supply (Vcc), and an output end connected to an output end of the bandgap core module and then grounded, wherein the bandgap core module comprises a first resistor (R1), a second resistor (R2), a third resistor (R3), a switching element (S) and a switching element group (SG), the differential amplification module is an operational amplifier (Amp), and the mirror current module comprises a first mirror current source module (MS1) and a second mirror current source module (MS2);

the first resistor (R1) is connected in parallel with the switching element (S), and the switching element group (SG) is connected in series with the third resistor (R3);

one end of the second resistor (R2), one end of the third resistor (R3) and one output end of the second mirror current source module (MS2) are connected at a second node (Nb) and to a non-inverting input end of the operational amplifier (Amp), and one end of the first resistor (R1), one end of the switching element (S) and one output end of the first mirror current source module (MS1) are connected at a first node (Na) and to an inverting input end of the operational amplifier (Amp); and a resistance of the first resistor (R1) is greater than that of the second resistor (R2), wherein, in a weak current conduction state, the voltage of the inverting input end of the operational amplifier (Amp) is greater than the voltage of the non-inverting input end of the operational amplifier (Amp) for the resistance of the first resistor (R1) is greater than that of the second resistor (R2), the currents through the first mirror current source module (MS1) and the second mirror current source module (MS2) are increased, and the voltage Va at the first node (Na) and the voltage Vb at the second node (Nb) are respectively further increased when the voltage of the inverting input end of the operational amplifier (Amp) is greater than the voltage of the non-inverting input end of the operational amplifier (Amp), and the switching element (S) and the switching element group (SG) are accordingly conducted.

8. The integrated circuit according to claim 7, wherein the starting module comprises a third mirror current source module, a fourth resistor and a Negative Channel Metal Oxide Semiconductor (NMOS) transistor;

a first input end of the first mirror current source module, a first input end of the second mirror current source module and a first input end of the third mirror current source module are connected to the power supply, and a second input end of the first mirror current source module, a second input end of the second mirror current source module (MS2), a second input end of the third mirror current source module and a drain of the NMOS transistor are connected to an output end of the operational amplifier;

the other end of the first resistor, the other end of the switching element, the other end of the second resistor, one end of the fourth resistor, one end of the switching element group and a source of the NMOS transistor are connected to a ground; and the other end of the fourth resistor is connected to one output end of the third mirror current source module.

9. The integrated circuit according to claim 8, wherein the first mirror current source module, the second mirror current source module and the third mirror current source module are respectively a first Positive Channel Metal Oxide Semiconductor (PMOS) transistor, a second PMOS transistor and a third PMOS transistor, and the first input end, the second input end and the output end of the each mirror current source module are respectively a source, a gate and a drain of the each PMOS transistor.

10. The integrated circuit according to claim 8, wherein the first mirror current source module, the second mirror current source module and the third mirror current source module are n series-connected PMOS transistors, and a connection relation of the n series-connected PMOS transistors is that: gates of the PMOS transistors are connected together, and for any two adjacent PMOS transistors, a source of one PMOS transistor is connected to a drain of the other PMOS transistor, and the n is a natural number greater than 1; and the first input end, the second input end and the output end of the each mirror current source module are respectively a source of a first PMOS transistor, a gate of any PMOS transistor and a drain of a last PMOS transistor among the corresponding n series-connected PMOS transistors.

11. The integrated circuit according to claim 8, wherein the switching element is a diode, and the switching element group comprises a plurality of parallel-connected diodes.

12. The integrated circuit according to claim 8, the switching element is a triode, and the switching element group comprises a plurality of parallel-connected triodes, a base and a collector of the triode are short circuited and connected to the ground, and a base and a collector of each triode among the parallel-connected triodes are respectively short circuited and connected to the ground.

* * * * *